US008091160B2

(12) United States Patent
Jin

(10) Patent No.: US 8,091,160 B2
(45) Date of Patent: Jan. 10, 2012

(54) FOLDABLE BED FRAME

(76) Inventor: Ki Ho Jin, Fujian (CN)

( * ) Notice: Subject to any disclaimer, the term of this patent is extended or adjusted under 35 U.S.C. 154(b) by 0 days.

(21) Appl. No.: 12/655,565

(22) Filed: Dec. 30, 2009

(65) Prior Publication Data

US 2010/0235989 A1 Sep. 23, 2010

(30) Foreign Application Priority Data

Mar. 17, 2009 (CN) ..... 2009 2 0137197 U

(51) Int. Cl.
*A47C 19/12* (2006.01)

(52) U.S. Cl. ..... 5/176.1; 5/174; 5/177; 5/178; 5/179

(58) Field of Classification Search ..... 5/174, 176.1, 5/177, 178, 179, 112, 114, 116, 117, 180, 5/310, 312, 282.1
See application file for complete search history.

(56) References Cited

U.S. PATENT DOCUMENTS

| | | | | |
|---|---|---|---|---|
| 648,304 | A | 4/1900 | Routier | |
| 718,159 | A | 1/1903 | Rundgvist | |
| 1,122,284 | A | 12/1914 | Kyle | |
| 1,167,123 | A | 1/1916 | Sinclair | |
| 1,204,792 | A | 11/1916 | Kyle | |
| 1,409,380 | A | 3/1922 | Irwin et al. | |
| 1,577,204 | A | 3/1926 | Davis | |
| 1,577,205 | A | 3/1926 | Davis | |
| 1,602,115 | A | 10/1926 | Malis | |
| 1,693,537 | A | 11/1928 | Adkins et al. | |
| 1,763,447 | A | 6/1930 | Schilling | |
| 1,810,311 | A | 6/1931 | Frey | |
| 2,591,551 | A * | 4/1952 | Kaplan | 5/110 |
| 3,967,330 | A | 7/1976 | Zawadowsky | |
| 4,243,263 | A | 1/1981 | Thiboutot | |
| 4,670,921 | A | 6/1987 | Avni et al. | |
| 5,711,040 | A | 1/1998 | Huang | |
| 6,134,727 | A | 10/2000 | Hwang | |
| 6,553,586 | B1 | 4/2003 | Lin | |
| 6,581,223 | B1 | 6/2003 | Wang | |
| 6,618,879 | B1 | 9/2003 | Wu | |
| 2006/0174415 | A1 | 8/2006 | Moulton | |

FOREIGN PATENT DOCUMENTS

| | | | |
|---|---|---|---|
| CN | 2376227 | Y | 5/2000 |
| CN | 2684640 | Y | 3/2005 |
| CN | 2902036 | Y | 5/2007 |
| GB | 2240034 | A | 7/1991 |
| GB | 2360700 | A | 10/2001 |
| JP | 4073008 | A | 3/1992 |

* cited by examiner

OTHER PUBLICATIONS

International Search Report, Dec. 25, 2007.

*Primary Examiner* — Jonathan Liu
(74) *Attorney, Agent, or Firm* — John H. Choi

(57) ABSTRACT

A foldable bed frame including first coupling members each having an opening facing outwardly with respect to the frame being in an open state; two sets of longitudinal beams, each formed by two longitudinal bars having two free ends, and two inner ends pivotally connected within one of the openings of the first coupling members. At least two transverse beams, each being formed by two transverse bars having first and second ends, the first ends respectively being pivotally connected together by a second coupling member. A plurality of third coupling members provided proximate to each free end of the longitudinal bars, each third coupling member having an opening facing inwardly with respect to the frame being in the open state, the opening being configured to pivotally connect one of the free ends of the longitudinal bars. A leg pivotally connected respectively proximate the free end of each longitudinal bar.

10 Claims, 10 Drawing Sheets

FOLDABLE BED FRAME

BACKGROUND OF THE INVENTION

1. Field of the Invention

The present invention relates to a foldable bed frame, specifically, to a bed frame capable of being folded into a compact state for easy transport and storage.

2. Description of Related Art

Conventional foldable bed frames are composed of two bed surfaces pivotally connected with each other, and includes four legs pivotally connected at lower portions of the bed surfaces. In use, the overall structure of the conventional foldable bed frame is similar to that in the present invention. However, as for the collapsed state, conventional bed frames are only capable of collapsing to half of its size as the two bed surfaces are merely folded against each other, and the bed frame is incapable of further collapsing to a more compact state.

BRIEF SUMMARY OF THE INVENTION

The present invention provides a foldable bed frame capable of reducing its structural components to a significantly more compact arrangement by folding or otherwise collapsing the metal bed frame into a configuration having a reduced size, so that the folded frame occupies minimal space during storage and/or transportation, which can further reduce storage and/or transportation costs associated therewith.

In order to achieve the above advantages, the present invention provides a foldable bed frame comprising a plurality of first pivotal coupling members, each of which having a groove opening facing outwardly with respect to the bed frame being in an open state; two sets of longitudinal beams, each set being formed by two longitudinal bars wherein the two longitudinal bars have two free ends, and two inner ends which are pivotally connected within one of the groove openings of the first pivotal coupling members; a plurality of second pivotal coupling members; at least two transverse beams, each transverse beam being formed by two transverse bars and each transverse bar has a first end and a second end, and wherein the first ends of each transverse beam are respectively pivotally connected by one of the second pivotal coupling members; a plurality of third pivotal coupling members provided along an inner side of and proximate to each free end of the longitudinal bars, each third pivotal coupling member having an opening facing inwardly towards an opposing longitudinal beam with respect to the bed frame being in the open state, the opening being configured to pivotally connect one of the free ends of the longitudinal bars; and a plurality of legs, wherein at least one of the plurality of legs is pivotally connected respectively along a lower side and proximate the free end of each longitudinal bar.

In one embodiment, the first pivotal coupling members are U-shaped. In another embodiment, each second pivotal coupling member comprises a pair of plates, each of which pivotally connects adjacent first ends of two of the transverse bars forming one of the transverse beams. Alternatively, the second pivotal coupling members are U-shaped.

In another embodiment, a third transverse beam is provided. The third transverse beam is formed by two transverse bars each having two first ends pivotally connected by another second pivotal coupling member, and two second ends affixed to respective intermediate members of the first pivotal coupling members, which are respectively located at medial positions along the two sets of the longitudinal beams. In another embodiment, at least one of the plurality of legs is pivotally connected respectively along the third transverse beam proximate the second end of each transverse bar.

Further, each of the plurality of legs can be pivotally connected to one of a longitudinal bar or transverse bar by a fourth pivotal coupling member. In another embodiment, the fourth pivotal coupling member includes a pair of substantially L-shaped plates and an intermediate member formed between opposing edges of the pair of plates.

In still another embodiment of the present invention, each second pivotal coupling member located at the first ends of adjacent transverse bars of each transverse beam includes a lower side having an auxiliary leg fixedly attached thereto.

BRIEF DESCRIPTION OF THE DRAWINGS

Further advantages and features of the present invention will become apparent from the detailed description of a preferred embodiment of the invention with reference to the accompanying drawings, in which.

Figure 1:
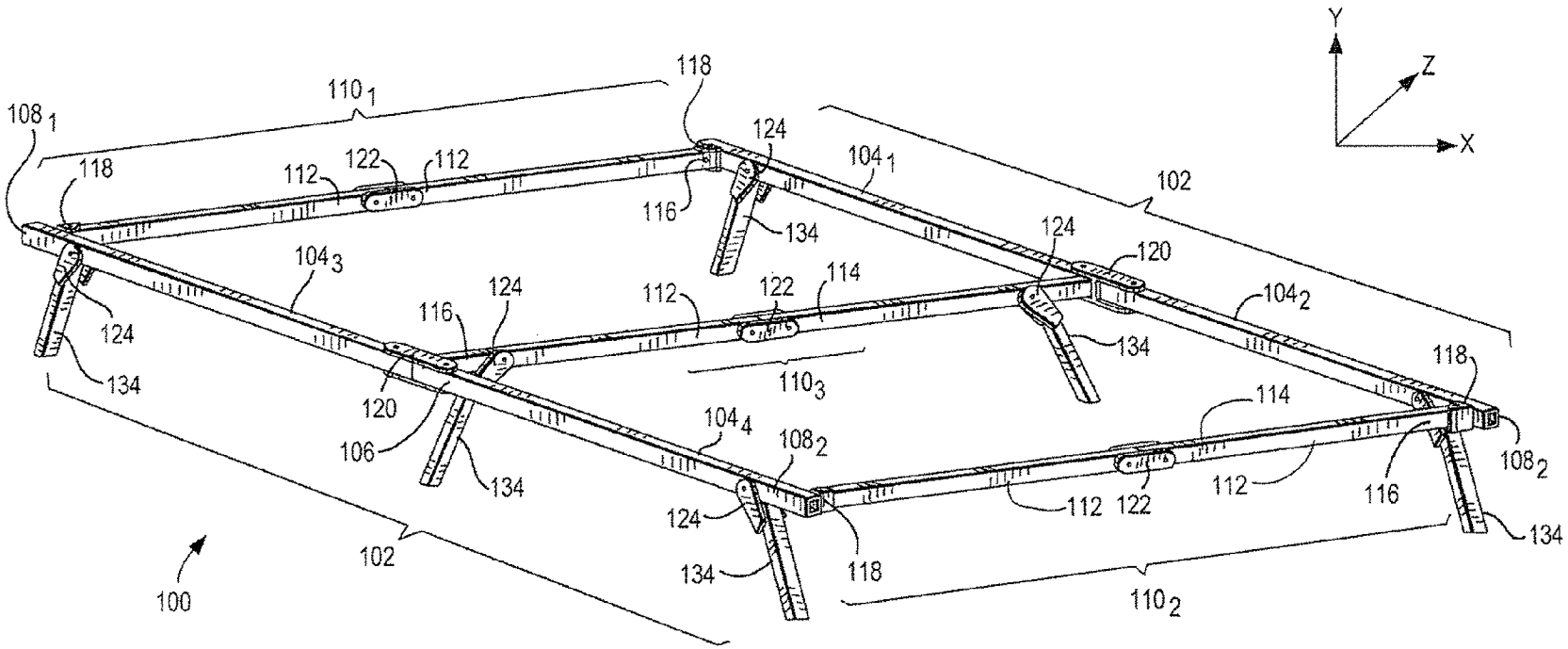
FIG. 1 is a top, left side perspective view illustrating a first embodiment of a foldable bed frame of the present invention in a completely expanded state.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Referring to FIG. 1, a first embodiment of a foldable bed frame 100 of the present invention is shown. The foldable bed frame 100 is illustratively shown in a fully open configuration and FIGS. 2-5 illustrate how the bed frame 100 can be easily folded into a significantly reduced size for convenient transport and/or storage. The bed frame 100 comprises a pair of longitudinal beams 102, three transverse beams 110 and at least four legs 134 (e.g., six legs shown). As illustratively shown in its open configuration of FIG. 1, the three transverse beams 110 are spaced substantially equidistance apart and each end is coupled normally to the longitudinal beams 102 to form a substantially rectangular bed frame 100. Specifically, a first transverse beam $\mathbf{110}_1$ is coupled between opposing first ends (i.e., free ends $\mathbf{108}_1$) of the longitudinal beams 102, and a second transverse beam $\mathbf{110}_2$ is coupled between opposing second ends (i.e., free ends $\mathbf{108}_2$) of the longitudinal beams 102. Preferably, a third transverse beam $\mathbf{110}_3$ is coupled centrally between the first and second ends of the longitudinal beams 102.

Each longitudinal beam 102 is formed by a pair of longitudinal bars 104 (e.g., $\mathbf{104}_1$-$\mathbf{104}_4$) having inner ends 106 that are pivotally connected together via a U-shaped first pivotal coupling member 120, and the other end of each longitudinal bar 104 form the free ends 108 of the longitudinal beams 102. An illustrative first pivotal coupling member 120 is shown and described below with respect to FIG. 11.

Figure 6:
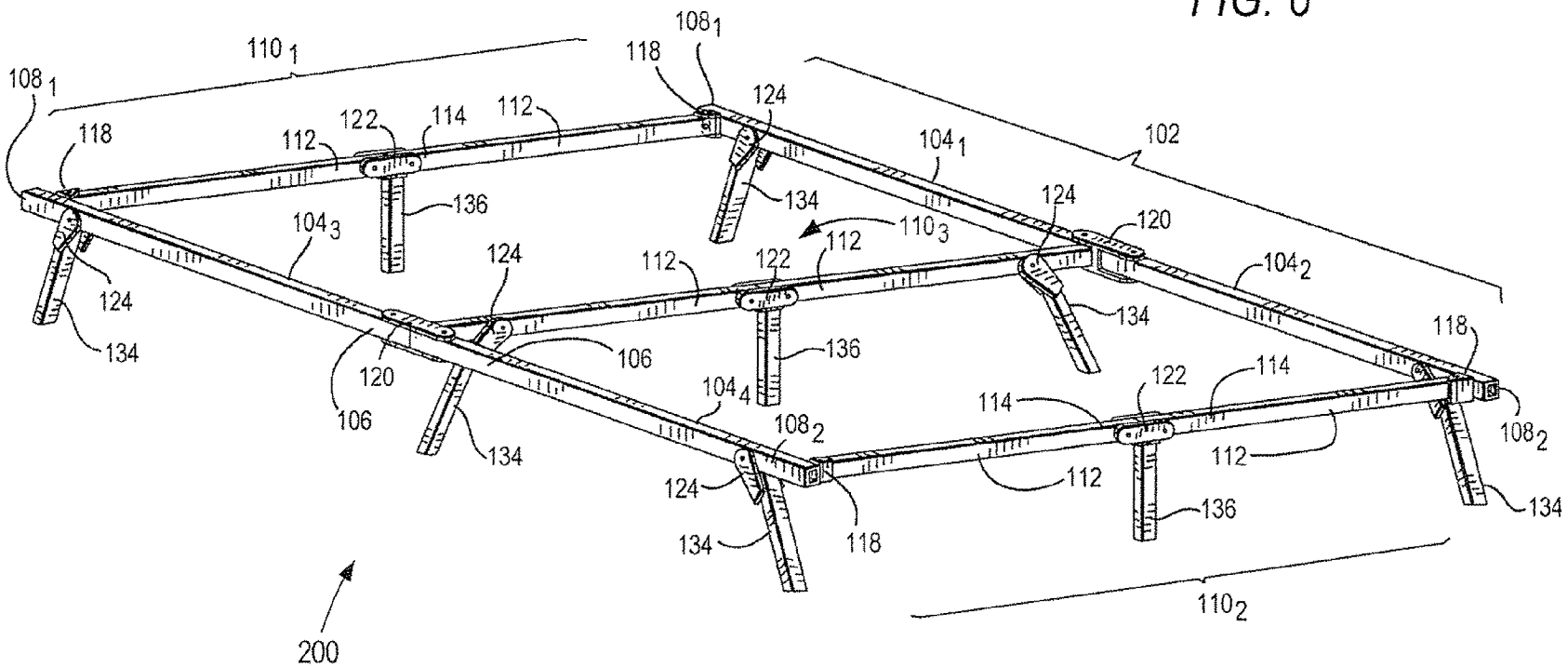
FIG. 6 is a top, left side perspective view illustrating a second embodiment of a foldable bed frame of the present invention in a completely expanded state.
Figure 11:
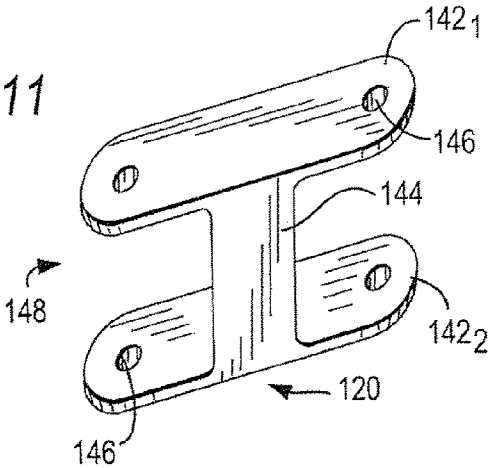
FIG. 11 is a top rear perspective view illustrating a first pivotal coupling member suitable for pivotally connecting longitudinal bars of the embodiments of FIGS. 1 and 6.

Referring to FIG. 11, an example of a first pivotal coupling member 120 is illustratively shown. The first pivotal coupling member 120 includes a pair of opposing plates $\mathbf{142}_1$ and $\mathbf{142}_2$ (collectively opposing plates 142), and an intermediate member 144 attached therebetween along a rear edge of the plates 142 to form a U-shaped bracket. The plates 142 are fixedly spaced apart by the intermediate member 144 a distance suitable for receiving the inner ends 106 of the longitudinal bars 104. The two opposing plates 142 are illustratively shown as being oval in shape, however, such shape and configuration is not limiting. For example, the plates 142 can be shaped rectangular. The area between the plates 142 and interior surface of the intermediate member 144 form a groove opening 148 which faces outwardly with respect to the bed frame while in an open state, and which receives the adjacent inner ends 106 of the longitudinal bars 104. The groove opening 148 provides a first plane of motion for the longitudinal bars 104. The first plane of motion is formed along the X-Z plane as shown in FIGS. 1 and 6, i.e., along the longitudinal axis of the longitudinal beams 102 and extending inwardly approximately 90 degrees towards a transverse bar 110 coupled normally with respect to the longitudinal beams 102. A pair of bores 146 are formed proximate each end of the plates $\mathbf{142}_1$ and $\mathbf{142}_2$, and each pair of opposing bores 146 in each plate are aligned to receive a fastener, such as a bolt, rod or other fastener (not shown) to secure the inner ends 106 of the longitudinal bars 104. Specifically, a pair of bolts or rods extend through the pair of axially aligned bores 146 formed in the opposing plates 142, and each bolt or rod extends through a bore (not shown) formed through the top and bottom walls of each inner end 106 of the longitudinal bars 104. The inner ends 106 of the longitudinal bars 104 pivot about the bolts or rods along the first plane of motion to enable the bed frame 100 to be configured in an open or closed arrangement. The outer portion of the intermediate members 144 faces inwardly and are preferably fixedly attached (e.g., welded, snap fit, secured with a fastener) to the second ends 116 of the central transverse beam $\mathbf{110}_3$ of the bed frame 100.

Similarly, each transverse beam 110 is formed by a pair of transverse bars 112 having first ends 114 pivotally connected together by a second pivotal coupling member 122. An illustrative second pivotal coupling member 122 that includes a pair of plates 162 is shown and described below with respect to FIG. 12. Alternatively, the U-shaped first pivotal coupling member 120 of FIG. 11 can be implemented as the second pivotal coupling member between the first ends 114 of the transverse bars 110, as illustratively shown and described with respect to FIG. 6. In this embodiment, the plane of motion is formed along the Y-Z plane as shown in FIGS. 1 and 6, i.e., along the longitudinal axis of the transverse beams 110 and extending inwardly approximately 90 degrees towards a longitudinal bar 104 coupled normally with respect to the transverse beams 110.

Figure 12:
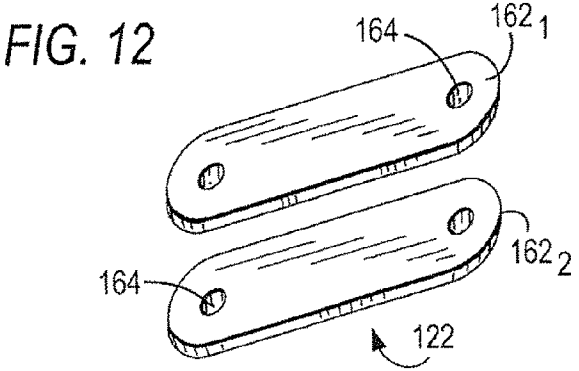
FIG. 12 is a top front perspective view illustrating a second pivotal coupling member suitable for pivotally connecting together transverse bars of the embodiments of FIGS. 1 and 6.

Referring to FIG. 12, an example of a second pivotal coupling member 122 is illustratively shown. The second pivotal coupling member 122 includes a pair of opposing plates $\mathbf{162}_1$ and $\mathbf{162}_2$ (collectively opposing plates 162). The plates 162 are illustratively shown as being substantially oval in shape, however, such shape and configuration is not limiting. For example, the plates 162 can be shaped rectangular. The pair of opposing plates 162 provides a second plane of motion for the transverse bars 112. The second plane of motion is formed along the Y-Z plane as shown in FIGS. 1 and 6, i.e., along the longitudinal axis of the transverse beams 110 and extending inwardly approximately 90 degrees towards a longitudinal bar 104 coupled normally with respect to the transverse beams 110. A pair of bores 164 are formed proximate each end of the plates $\mathbf{162}_1$ and $\mathbf{162}_2$, and opposing bores 164 in each plate 162 are aligned to receive a fastener, such as a bolt, rod or other fastener (not shown) to secure the opposing sides of the first (inner) ends 114 of the transverse bars 112. The bolt or rod extends through the both plates and the sides of the transverse bar 112 sandwiched therebetween. The first ends 114 of the transverse bars 112 pivot about the bolts or rods along the second plane of motion to enable the bed frame 100 to be configured in an open or closed arrangement. Although the second pivotal coupling member 122 preferably includes a pair of plates $\mathbf{162}_1$ and $\mathbf{162}_2$, a person of ordinary skill in the art will appreciate that a single plate can be attached to only one side of the first ends 114 of the transverse bars 112.

With further respect to the first and second transverse beams $\mathbf{110}_1$ and $\mathbf{110}_2$, the second opposing ends 116 of each transverse bar 112 is pivotally attached to a side portion of one of the pairs of longitudinal beams 102. In particular, each second end 116 of the first and second transverse beams $\mathbf{110}_1$ and $\mathbf{110}_2$ is pivotally coupled to the free ends 108 of the longitudinal bars 104 by a third pivotal coupling member 118. The third pivotal coupling members 118 are respectively provided along the inner sides of the longitudinal bars 104 proximate the free ends 108, such that an opening 160 of the third pivotal coupling members 118 face inwardly towards each other at the opposing free ends 108 of the longitudinal bars 104. An illustrative third pivotal coupling member 118 is shown and described below with respect to FIG. 13. Where a third transverse beam $\mathbf{110}_3$ is provided, the respective second ends 116 are fixedly coupled to the opposing first pivotal coupling members 120 positioned proximately along the central portion of the longitudinal bars 104.

Figure 13:
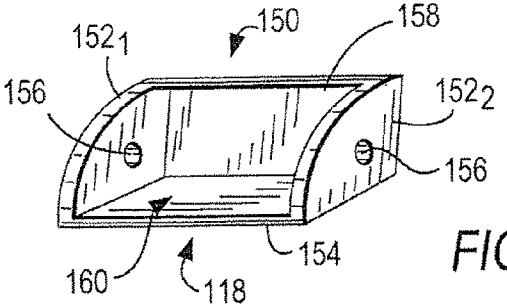
FIG. 13 is a top front perspective view illustrating a third pivotal coupling member suitable for pivotally connecting transverse bars with longitudinal bars of the embodiments of FIGS. 1 and 6.

Referring to FIG. 13, an example of a third pivotal coupling member 118 is illustratively shown. The third pivotal coupling member 118 includes an L-shaped bracket member 150 having a first member 154 affixed substantially orthogonal to a second member 158. First and second side plates $\mathbf{152}_1$ and $\mathbf{152}_2$ (collectively opposing side plates 152) are affixed to the opposing sides of the L-shaped bracket 150. The side plates 152 can be configured in a quarter-round circular shape and include axially aligned bores 156 dimensioned to receive a bolt, rod or other fastener (not shown). The shape of the side plates 152 is not considered limiting as a rectangular or other curvilinear shape is contemplated. The L-shaped bracket 150 includes an open portion 160 which is dimensioned to receive the second end 116 of a transverse bar 112. The open portion 160 provides a third plane of motion for the transverse bars 112 of the two transverse beams $\mathbf{110}_1$ and $\mathbf{110}_2$. The third plane of motion is formed along the X-Y plane as shown in FIGS. 1 and 6, i.e., along the longitudinal axis of the longitudinal beams 102 and extends inwardly or downwards approximately 90 degrees from a position normal with and respect to the longitudinal beams 102. A bolt, rod or other fastener extends through the pair of axially aligned bores 158 formed in the opposing plates 152 and the bolt or rod further extends through a bore (not shown) formed through the side walls at the second end 116 of a transverse bar 112. The second end 116 of a transverse bar 112 pivots about the bolt or rod (i.e., axle) along the third plane of motion to enable the bed frame 100 to be configured in an open or closed arrangement. The rear portion of the first member 154 or second member 158 of each third pivotal coupling member 118 is fixedly attached to a corresponding inner side surface of the longitudinal bar 104 at the free end 108, such that the opening 160 of each third pivotal coupling member 118 faces inward towards an opening 160 of an opposing third pivotal coupling member 118. The first member 154 or second member 158 is preferably fixedly attached to the inner side surface of the longitudinal bar 104 by welding, snap fit, secured with a fastener, among other well-known fastening techniques. While closing the bed frame 100, each third pivotal coupling member 118 enables a corresponding transverse bar 112 to rotate approximately ninety (90) degrees inwardly with respect to the longitudinal bars 104.

Figure 4:
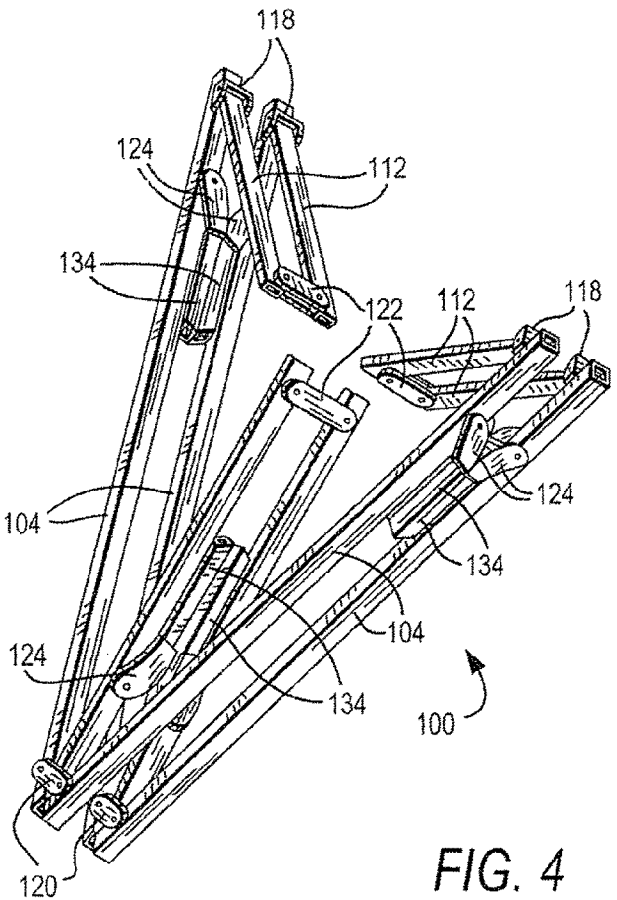
FIG. 4 is a top, left side perspective view illustrating a third collapsing operation of the bed frame of FIG. 1.
Figure 3:
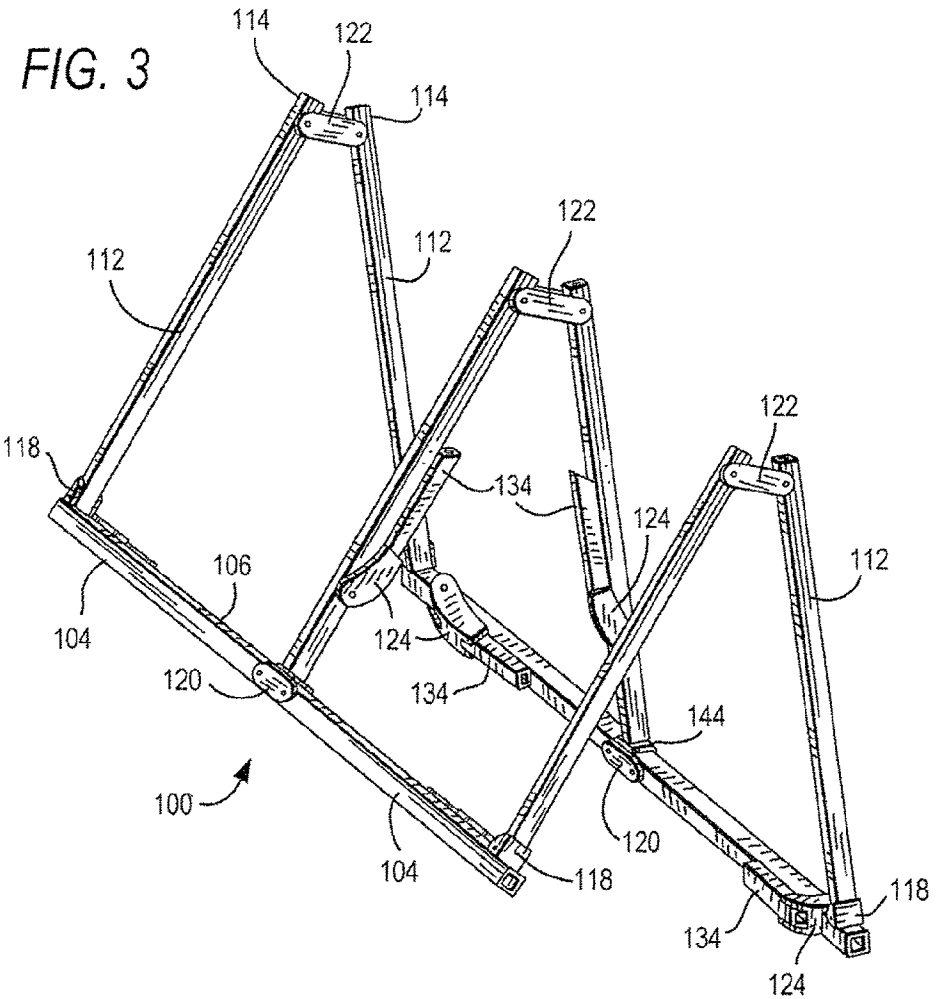
FIG. 3 is a top, left side perspective view illustrating a second collapsing operation of the bed frame of FIG. 1.

Specifically, with respect to the two transverse beams $\mathbf{110}_1$ and $\mathbf{110}_2$ located at a front end and a rear end of the bed frame 100, each respective transverse bar 112 is collapsible towards the central portion of the bed frame 100 with respect to the corresponding longitudinal beam 102, as illustratively shown in FIGS. 3 and 4. The direction of rotation of the transverse bars 112 with respect to the longitudinal bars 104 is restricted by the positioning of the opening 160 of the third pivotal coupling member 118, i.e., to permit rotation or folding of the transverse bars 110 only along the longitudinal axis of the longitudinal bars 104.

At least four legs 134 are provided to support the bed frame 100. In one embodiment, a leg 134 is pivotally attached proximate to each free end 108 of the longitudinal bars 104 by a fourth pivotal coupling member 124. An illustrative fourth pivotal coupling member 124 is shown and described below with respect to FIG. 14. Where a third transverse beam $\mathbf{110}_3$ is provided, a leg 134 can also pivotally attached via the fourth pivotal coupling member 124 proximate each second end 116 of the transverse bars 112, such that six legs 134 are provided to support the bed frame 100, as illustratively shown in FIG. 1.

When the bed frame 100 is in the open configuration, the two longitudinal bars 104 are axially aligned and extend horizontally with respect to the flooring to form the longitudinal beams 102. Further, each pair of the transverse bars 112 are axially aligned and extend horizontally with respect to the flooring to form a respective transverse beam 110. The legs 134 located in the lower side of the each longitudinal bar 104 and the lower side of the central transverse beam $\mathbf{110}_3$ extend downward to provide support for the open configured bed frame structure 100. Preferably, each fourth pivotal coupling member 124 pivotally connecting each leg 134 is a pivot component having an angle of more than 90 degrees (i.e., substantially L-shaped), so that each of the legs 134 is positioned downward towards the flooring at a stable angle with respect to the bars 104 and 112, to thereby prevent the leg 134 from collapsing backwards. The legs 134 are pivotally connected such that they fold inwardly when the bed frame 100 is collapsed into a closed arrangement.

Figure 14:
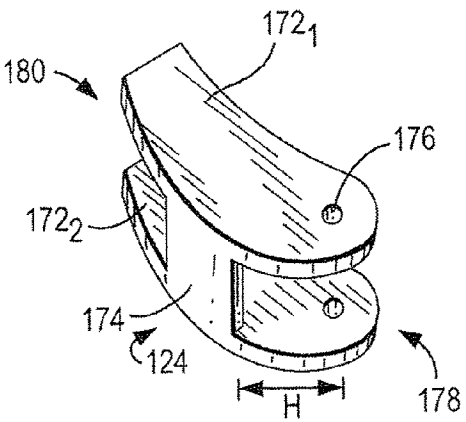
FIG. 14 is a top rear perspective view illustrating fourth pivotal coupling member suitable for pivotally connecting legs to longitudinal bars or transverse bars of the embodiments of FIGS. 1 and 6.
Figure 16:
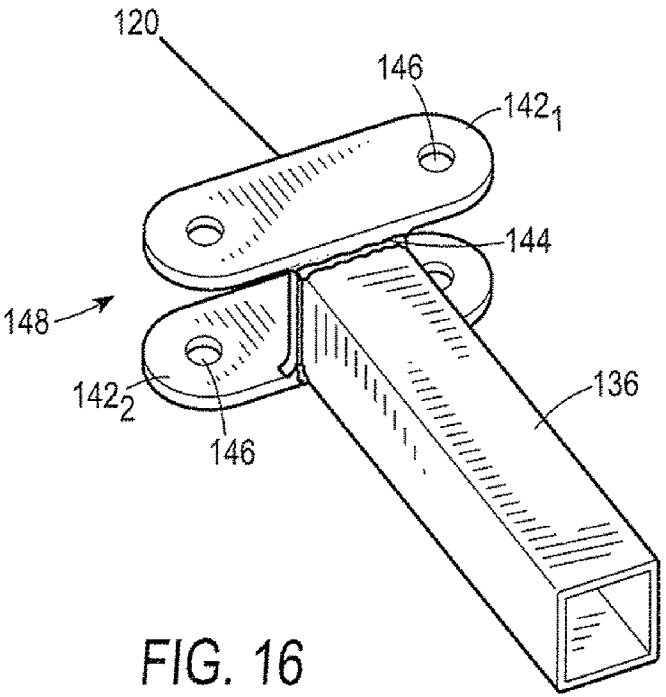
FIG. 16 is a perspective view illustrating an auxiliary leg fixed to the bottom surface of a first pivotal coupling member.
Figure 15:
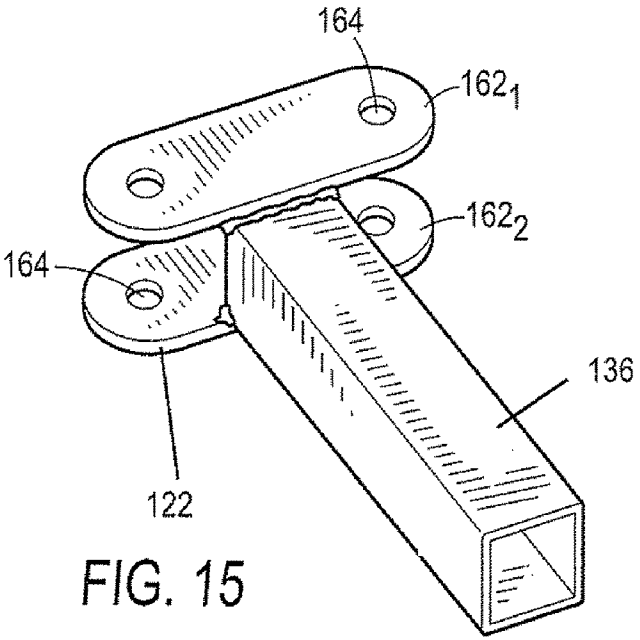
FIG. 15 is a perspective view illustrating an auxiliary leg fixed to the bottom surface of a second pivotal coupling member.

Referring to FIG. 14, an example of a fourth pivotal coupling member 124 is illustratively shown. The fourth pivotal coupling member 124 includes a pair of L-shaped plates $\mathbf{172}_1$ and $\mathbf{172}_2$ (collectively opposing side plates 172), and an intermediate member 174 attached therebetween along a rear edge of the plates 172. The plates 172 are fixedly spaced apart by the intermediate member 174 a distance suitable for receiving the upper portion of the legs 134. The pair of opposing plates 172 and intermediate member 174 collectively provide a fourth plane of motion for the legs 134. The fourth plane of motion is formed along the X-Y plane as shown in FIGS. 1 and 6, along the longitudinal axis of the longitudinal beams 102 and extends inwardly or upwards approximately 90 degrees from a position normal with and respect to the longitudinal beams 102. A pair of bores 176 are formed proximate a first end 178 of the plates $\mathbf{172}_1$ and $\mathbf{172}_2$, and the opposing bores 176 in each plate are aligned to receive a fastener, such as a bolt or rod (not shown) to pivotally secure it along the opposing side walls of the longitudinal bars 104. Specifically, a bolt, rod or other fastener extends through the axially aligned bores 176 formed in the opposing L-shaped plates 172 and the bolt or rod extends through a bore (not shown) formed through the opposing side walls of each free end 108 of the longitudinal bars 104. The opposing second end 180 of the L-shaped plates 172 fixedly receives a corresponding leg 134. The legs 134 can be attached to the second end of the L-shaped plates 172 by welding, snap-fit, or a fastener, such as a sheet metal screw, bolt(s) and the like. Two additional legs 134 and corresponding fourth pivotal coupling members 124 can be attached to the opposing second ends 116 of the central transverse beam $\mathbf{110}_3$ in a similar manner. The height (h) of the intermediate member 174 with respect to the pivot point of the plates 172 is a distance suitable to limit the rotation of the leg 134. A fifth plane of motion is formed along the Z-Y plane as shown in FIGS. 1 and 6, i.e., along the longitudinal axis of the transverse beam $\mathbf{110}_3$ and extends inwardly or upwards at least 90 degrees from a position normal with and respect to the longitudinal beams 102. Specifically, the legs 134 can rotate in a range of at least 90 degrees to approximately 120 degrees, and preferably in the range of 100-110 degrees with respect to the longitudinal bars 104, although the range of rotation is not considered limiting. In this manner, the upper edge of the intermediate member 174 serves as a fixed barrier to prevent the legs 134 from rotating 180 degrees with respect to the longitudinal bars 104, which would allow the bed frame 100 to inadvertently collapse to the floor. The fourth pivotal coupling member 124 is attached to the sides of the longitudinal or transverse bars such that second end 180 of the L-shaped plates 172 face inwardly, to thereby enable the legs 134 to rotate or fold inwardly when the bed frame 100 is being closed.

Figure 2:
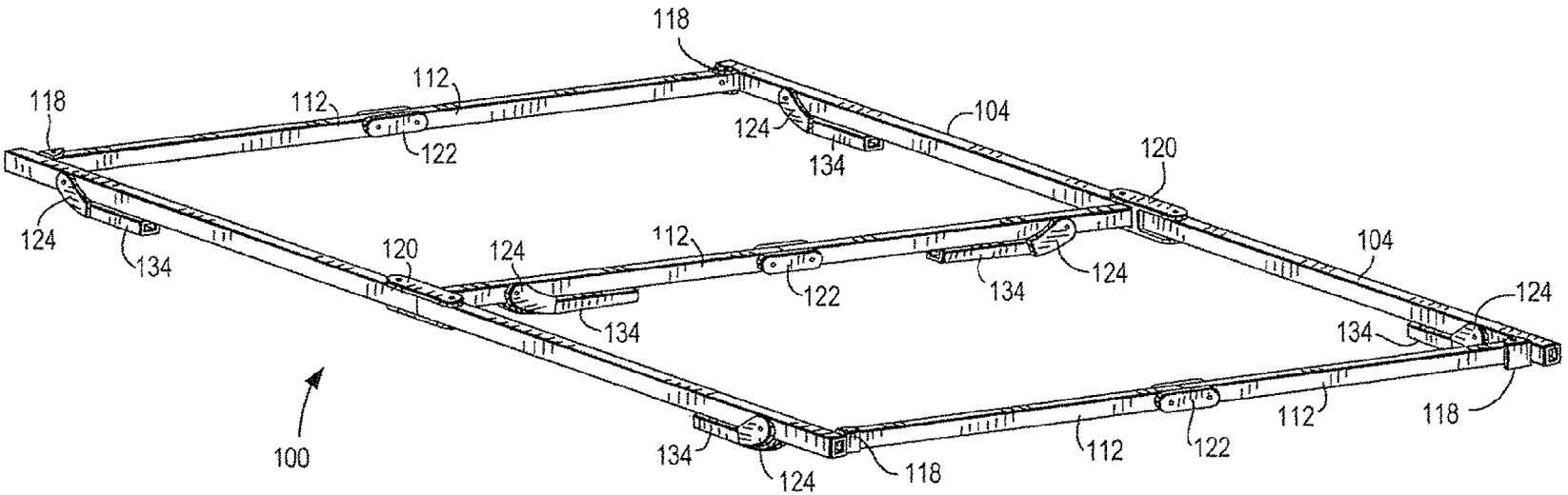
FIG. 2 is a top, left side perspective view illustrating a first collapsing operation of the bed frame of FIG. 1.

FIGS. 2-5 illustrate the folding process of the metal-frame bed structure 100 of FIG. 1. Referring now to FIG. 2, the four legs 134 connected to the free ends 108 of the longitudinal bars 104 are respectively folded inwardly and positioned against or proximate the lower side of each corresponding longitudinal bar 104. Further, the two legs 134 connected to the second ends 116 of the transverse bars 112 are respectively folded inwardly against or proximate the lower side of the each corresponding transverse bar 112. In particular, each L-shaped fourth pivotal coupling member 124 and corresponding leg 134 is rotated inwardly along its longitudinal axis towards the center of the bed frame 100 in an upward direction, and until the leg 134 is positioned adjacent and substantially parallel to the corresponding longitudinal bar 104 and/or transverse bar 112.

Referring to FIG. 3, the paired second ends 116 of two transverse bars 112 forming each of the three transverse beams 110 are rotated inwardly about the second pivotal coupling member 122 until the two longitudinal beams 102 are arranged parallel to each other and the three transverse beams 110 extend upward and are positioned substantially orthogonal with respect to the longitudinal beams 102. In this manner, the first ends 114 of the transverse bars 112 are rotated about their corresponding pivot points (e.g., bolts or rods) on the second pivotal coupling members 122.

Referring now to FIG. 4, the transverse bars 112 at two ends of each longitudinal beam 102 (i.e., transverse beams $\mathbf{110}_1$ and $\mathbf{110}_2$) are rotated inward about the bolt or rod of the third pivotal coupling member 118 (i.e., folded along the longitudinal axis of the longitudinal beams 102) and positioned towards the inner sides of the corresponding longitudinal bars 104. In this manner, the transverse bars 112 at two ends of each longitudinal beam 102 are positioned parallel to the respective adjacent longitudinal bars 104.

Figure 5:
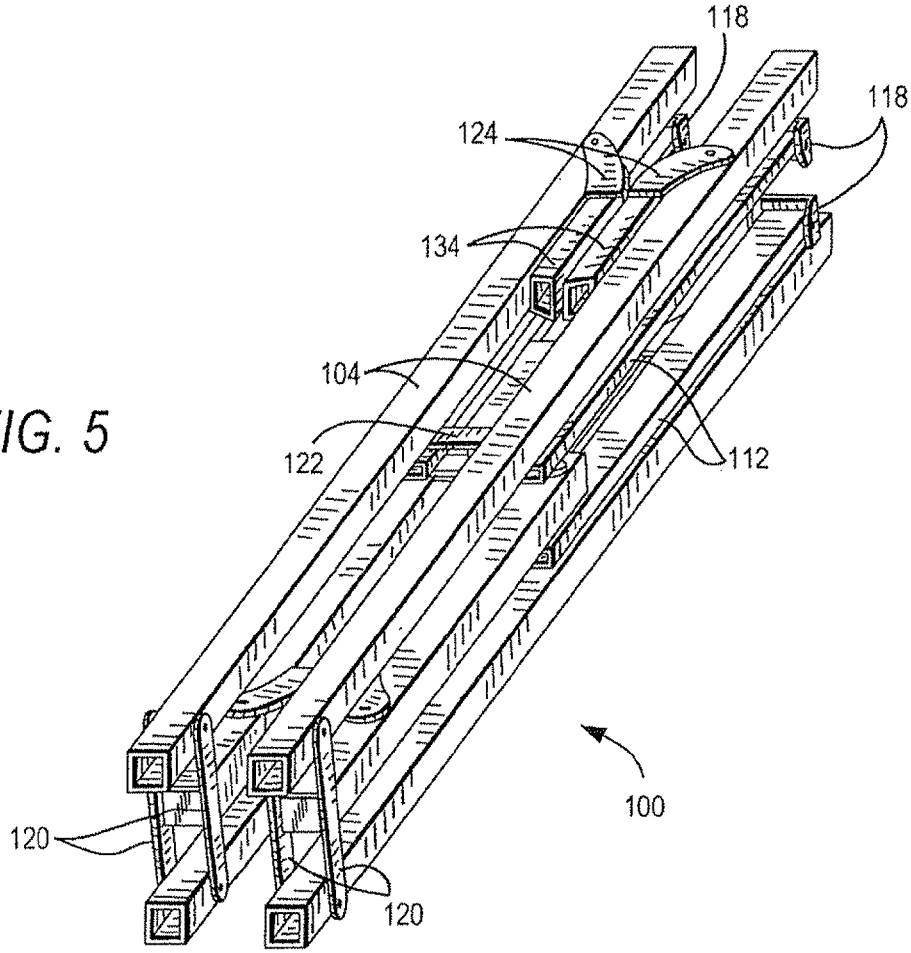
FIG. 5 is a perspective view illustrating the bed frame of FIG. 1 in a completely collapsed state.

Referring to FIGS. 4 and 5, the free ends $\mathbf{108}_1$ and $\mathbf{108}_2$ of the two longitudinal bars 104 of each longitudinal beam 102 are raised upward towards each other by rotating the longitudinal bars 104 about the corresponding pivot points provided by the first pivotal coupling member 120. The longitudinal bars 104 are rotated until they are positioned together in at least a substantially parallel arrangement as shown in FIG. 5. Accordingly, longitudinal bars 104 and the transverse bars 112 of the bed frame 100 are collectively folded together in a parallel arrangement to significantly reduce the overall footprint of the bed frame 100, thereby making it easier to transport and store. A person of ordinary skill in the art will appreciate that the bed frame 100 can be opened fully by reversing the folding actions set forth and described above with respect to FIGS. 2-5.

Referring to FIGS. 6-10, a second embodiment of the present invention is illustratively shown. The bed frame 200 of the second embodiment is the same as the first embodiment of the bed frame 200 of FIGS. 1-5, except that an auxiliary leg 136 is fixed to the bottom surface of each second pivotal coupling member 122 located between the first ends 114 of the transverse bars 112 of each transverse beam 110. As noted above with respect to FIG. 1, the first pivotal coupling member 120 of FIG. 11 can alternatively be used in place of the second pivotal coupling member 122 of FIG. 12. In particular, the U-shaped first pivotal coupling member 120 is positioned between the first ends 114 of the opposing transverse bars 112 as described above with respect to the second pivotal coupling member 122. In this embodiment, the intermediate member 144 is positioned adjacent the lower surfaces of the first ends 114 of the opposing transverse bars 112, such that the rear or external flat surface of the intermediate member 144 faces the flooring.

The auxiliary legs 136 can be fixedly attached to the bottom external portion of the intermediate member 144 of the pivotal coupling member 120 by welding, snap-fit, or one or more fasteners. The intermediate member 144 supports the bottom portion of the first ends 114 of the transverse bars 112, and advantageously prevents the first ends 114 of the transverse bars 112 from inadvertently collapsing downward towards the flooring. Thus, the intermediate member 144 restricts the rotational movement of the first ends 114, as the tips of the first ends 114 of the transverse bars 112 can only be rotated in and upward direction as shown in FIG. 3. Further, the auxiliary legs 136 provide additional supporting strength at the medial positions of the bed frame 200 once the bed frame 200 is expanded to its fully open arrangement.

Figure 7:
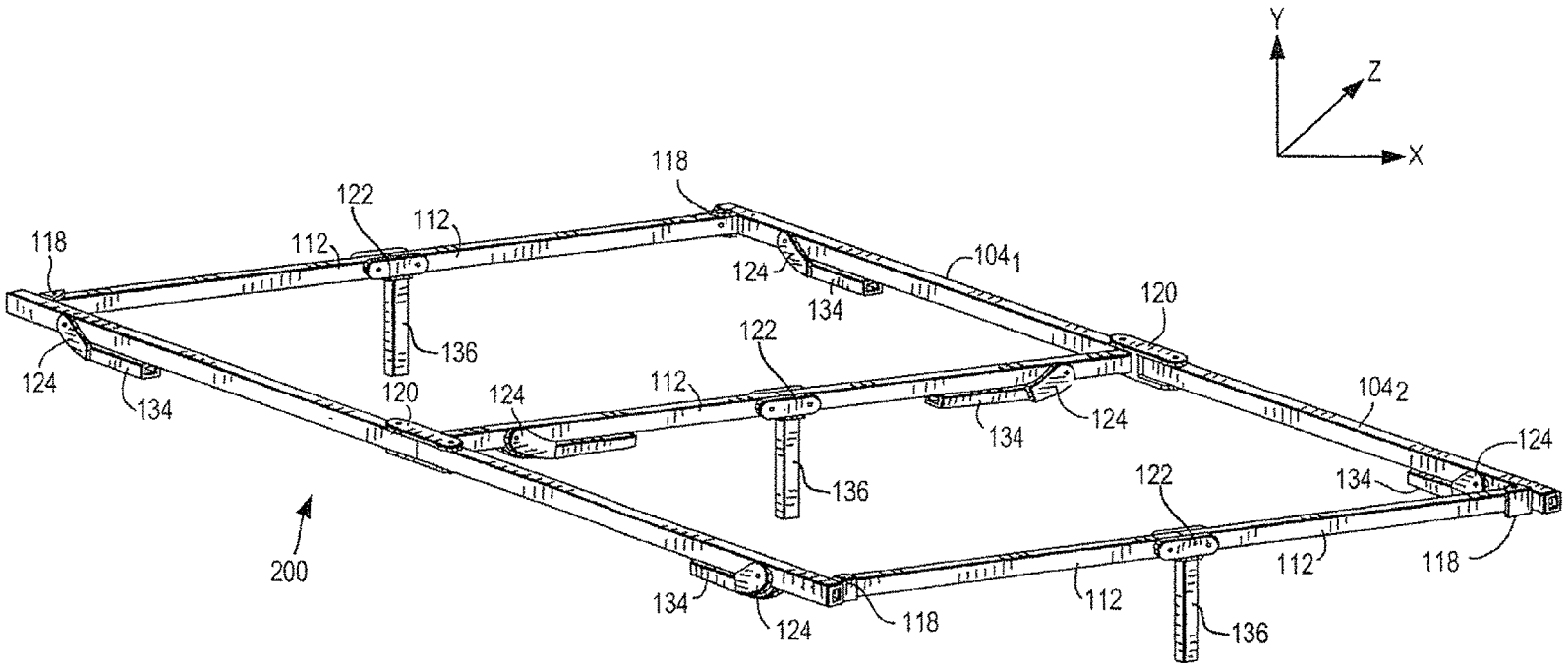
FIG. 7 is a top, left side perspective view illustrating a first collapsing operation of the bed frame of FIG. 6.

FIGS. 7-10 illustrate the folding process of the metal-frame bed structure 100 of FIG. 1. Referring now to FIG. 7, the four legs 134 connected to the free ends 108 of the longitudinal bars 104 are respectively folded inwardly and positioned against or proximate the lower side of each corresponding longitudinal bar 104. Further, the two legs 134 connected to the second ends 116 of the transverse bars 112 are respectively folded inwardly against or proximate the lower side of the each corresponding transverse bar 112. In particular, each L-shaped fourth pivotal coupling member 124 and corresponding leg 134 is rotated inwardly along its longitudinal axis towards the center of the bed frame 100 in an upward direction, and until the leg 134 is positioned adjacent and substantially parallel to the corresponding longitudinal bar 104 and/or transverse bar 112. The auxiliary legs 136 coupled to the U-shaped second pivotal coupling members 120 remain in normal position with respect to the lower side of the respective intermediate members 144 of the second pivotal coupling members 120.

Figure 8:
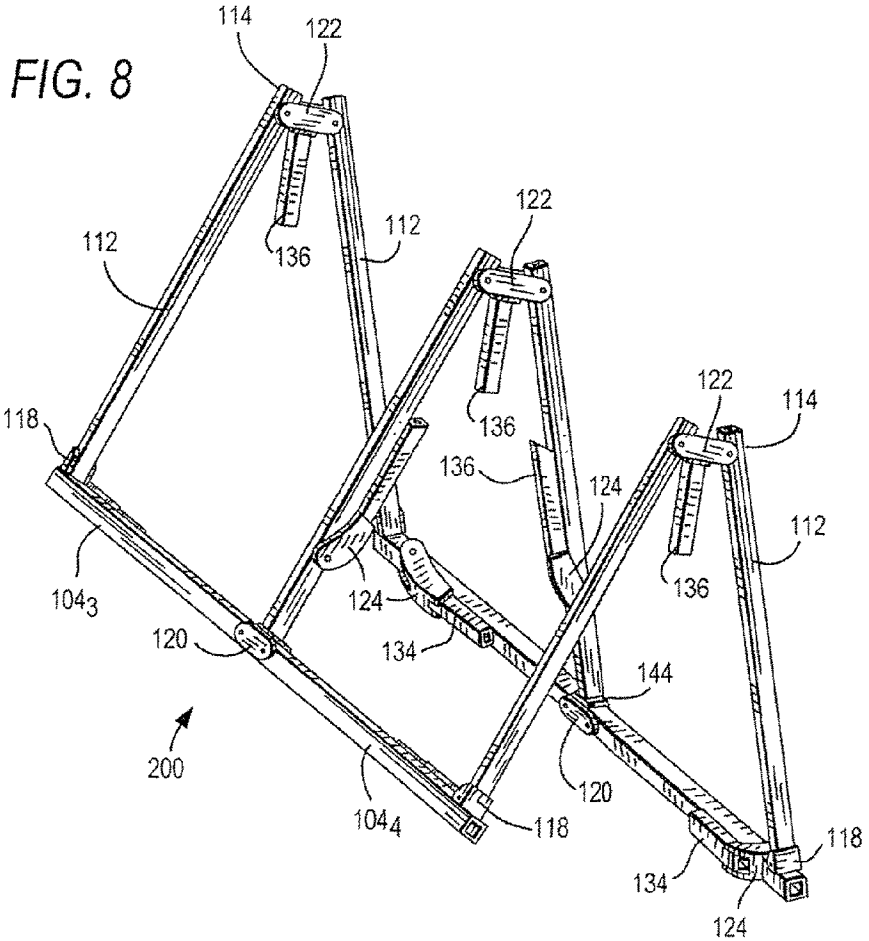
FIG. 8 is a top, left side perspective view illustrating a second collapsing operation of the bed frame of FIG. 6.

Referring to FIG. 8, the paired second ends 116 of two transverse bars 112 forming each of the three transverse beams 110 are rotated inwardly about the second pivotal coupling member 122 until the two longitudinal beams 102 are arranged parallel to each other and the three transverse beams 110 extend upward and are positioned substantially orthogonal with respect to the longitudinal beams 102. In this manner, the first ends 114 of the transverse bars 112 are rotated about their corresponding pivot points (e.g., bolts or rods) on the second pivotal coupling members 122 and are positioned substantially parallel with the auxiliary legs 136.

Figure 9:
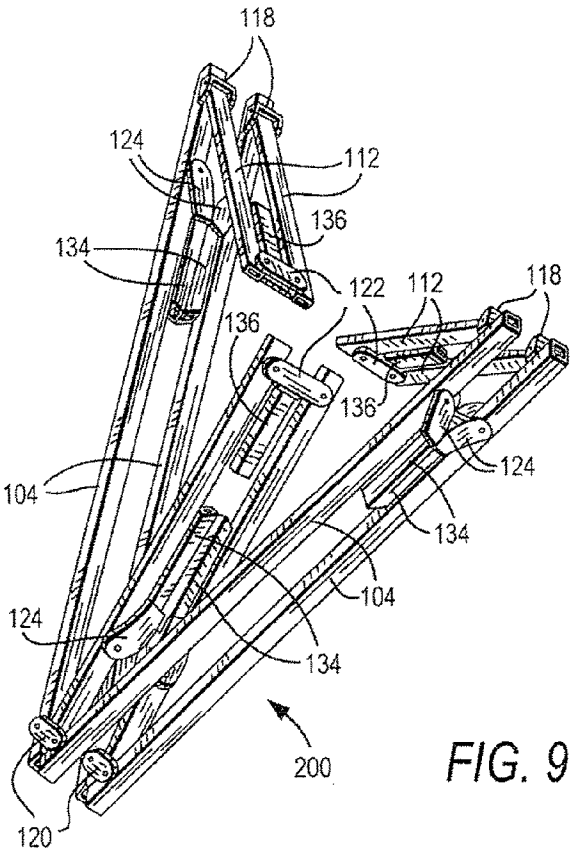
FIG. 9 is a top, left side perspective view illustrating a third collapsing operation of the bed frame of FIG. 6.

Referring now to FIG. 9, the transverse bars 112 at two ends of each longitudinal beam 102 (i.e., transverse beams $\mathbf{110}_1$ and $\mathbf{110}_2$) are rotated inward about the bolt or rod of the third pivotal coupling member 118 (i.e., folded along the longitudinal axis of the longitudinal beams 102) and positioned towards the inner sides of the corresponding longitudinal bars 104. In this manner, the transverse bars 112 at two ends of each longitudinal beam 102 are positioned parallel with to the respective adjacent longitudinal bars 104.

Figure 10:
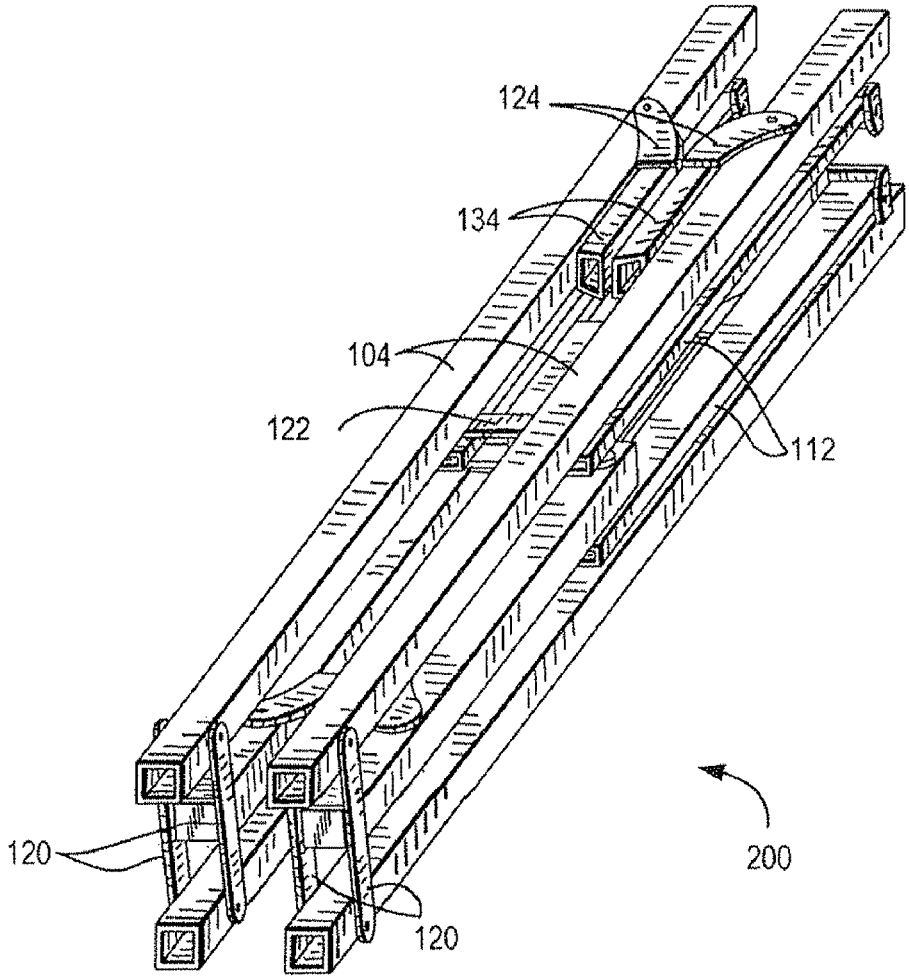
FIG. 10 is a perspective view illustrating the bed frame of FIG. 6 in a completely collapsed state.

Referring to FIGS. 9 and 10, the free ends $\mathbf{108}_1$ and $\mathbf{108}_2$ of the two longitudinal bars 104 of each longitudinal beam 102 are raised upward towards each other by rotating the longitudinal bars 104 about the corresponding pivot points provided by the first pivotal coupling member 120. The longitudinal bars 104 are rotated until they are positioned together in at least a substantially parallel arrangement as shown in FIG. 10. Accordingly, longitudinal bars 104 and the transverse bars 112 of the bed frame 100 are collectively folded together in a parallel arrangement to significantly reduce the overall footprint of the bed frame 100, thereby making it easier to transport and store. A person of ordinary skill in the art will appreciate that the bed frame 100 can be opened fully by reversing the folding actions set forth and described above with respect to FIGS. 7-10.

The present invention illustrates two metal-frame bed frame embodiments 100 and 200, each of which are constructed such that both the longitudinal beams 102 and the transverse beams 110 of the bed frame 100 are formed by pairs of axially aligned bars (i.e., longitudinal bars 104 and transverse bars 112) which are pivotally connected together medially along their respective longitudinal axis. The two longitudinal bars 104 of the each longitudinal beam 102 are unidirectionally pivotally connected towards the outer sides of the bed frame 100, and each transverse bar 112 of the each transverse beams 110 is unidirectionally pivotally connected to the respective longitudinal bar towards an inner side of the bed frame 100. That is, the bars of the beams are arranged such that the pivot points permit the bars to rotate along a single plane. Further, each leg 134 is unidirectionally pivotally connected so that when the bed frame 100 is folded to a reduced size, each of the longitudinal and transverse bars can be folded compactly together along the unidirectional pivotal connecting direction of each bar, and the folded bed frame 100 can be minimized to a configuration that not only facilitates reduced storage space but also makes transportation easier which can further reduce transportation costs.

While the foregoing is directed to embodiments of the present invention, other and further embodiments of the invention can be devised without departing from the basic scope thereof, and the scope thereof is determined by the claims that follow.

What is claimed is:

1. A foldable bed frame, which is expandable and collapsible into an open state and closed state, respectively, comprising:

a plurality of first pivotal coupling members, each of which having a groove opening facing outwardly with respect to the bed frame being in the open state;

a pair of longitudinal beams, each pair of longitudinal beams being formed by a pair longitudinal bars, each longitudinal bar having a free end and an inner end, wherein adjacent inner ends of each of the pair of longitudinal bars are pivotally connected together within one of the groove openings of one of the plurality of the first pivotal coupling members;

a plurality of second pivotal coupling members;

a pair of transverse beams, each transverse beam being formed by a pair of transverse bars, each transverse bar having a first end and a second end, wherein adjacent first ends of each of the pair of transverse bars are pivotally connected together by one of the plurality of second pivotal coupling members;

a plurality of third pivotal coupling members each of which is respectively provided along an inner side of and proximate to each free end of the longitudinal bars, each third pivotal coupling member being configured to have an opening facing inwardly towards an opposing longitudinal beam while the bed frame is expanded to the open state, the opening of each third pivotal coupling member being configured to pivotally connect one of the second ends of one of the pair of transverse bars of each pair of transverse beams such that the transverse beams extend substantially normal to the longitudinal beams in the open state; and a plurality of legs, wherein a first portion of the plurality of legs comprises four legs that are independently movable, each of the four independently movable legs being pivotally connected to a corresponding lower side of the free end of each longitudinal bar.

2. The foldable bed frame according to claim 1, wherein the pair of first pivotal coupling members are U-shaped coupling members.

3. The foldable bed frame according to claim 1, wherein each of the plurality of second pivotal coupling members comprises a pair of plates.

4. The foldable bed frame according to claim 1, further comprising:

a third transverse beam extending substantially normal between the pair of longitudinal beams and formed by a third pair of transverse bars, each of which having two first ends pivotally connected by one of the plurality of second pivotal coupling members and two second ends, each of which being affixed to one of the first pivotal coupling members, wherein the third transverse beam is positioned medially between each of the free ends of the pair of longitudinal beams.

5. The foldable bed frame according to claim 4, wherein a second portion of the plurality of legs comprises at least one auxiliary leg respectively being pivotally connected to at least one transverse beam.

6. The foldable bed frame according to claim 5, wherein each second pivotal coupling member located at the first ends of adjacent transverse bars of the each transverse beam are U-shaped coupling members having a respective auxiliary leg fixedly attached thereto.

7. The foldable bed frame according to claim 4, further comprising a pair of lateral legs that are independently movable, each of the pair of independently movable lateral legs being pivotally connected to a corresponding second end of the third pair of transverse bars.

8. The foldable bed frame according to claim 1, wherein each of the first portion of movable legs is pivotally connected to the longitudinal bars by a fourth pivotal coupling member.

9. The foldable bed frame according to claim 8, wherein each of the fourth pivotal coupling members includes a pair of substantially L-shaped plates and an intermediate member formed between opposing edges of the pair of plates.

10. The foldable bed frame according to claim 1, wherein the plurality of second pivotal coupling members are U-shaped.

* * * * *